US008751409B2

(12) United States Patent
Hill et al.

(10) Patent No.: US 8,751,409 B2
(45) Date of Patent: Jun. 10, 2014

(54) SYSTEM AND METHOD FOR SECURELY DISSEMINATING AND MANAGING POSTAL RATES

(75) Inventors: George Hill, Saratoga, CA (US); Richard Hernandez, Half Moon Bay, CA (US)

(73) Assignee: PSI Systems, Inc., Palo Alto, CA (US)

( * ) Notice: Subject to any disclaimer, the term of this patent is extended or adjusted under 35 U.S.C. 154(b) by 242 days.

(21) Appl. No.: 13/228,859

(22) Filed: Sep. 9, 2011

(65) Prior Publication Data

US 2013/0066794 A1 Mar. 14, 2013

(51) Int. Cl.
*G06Q 30/00* (2012.01)

(52) U.S. Cl.
USPC ..... 705/330

(58) Field of Classification Search
USPC ..... 705/330
See application file for complete search history.

(56) References Cited

U.S. PATENT DOCUMENTS

| | | | | |
|---|---|---|---|---|
| 5,117,364 | A | 5/1992 | Barns-Slavin et al. | |
| 5,319,562 | A | 6/1994 | Whitehouse | |
| 5,448,641 | A | 9/1995 | Pintsov et al. | |
| 5,812,990 | A | 9/1998 | Ryan, Jr. et al. | |
| 5,822,739 | A | 10/1998 | Kara | |
| 6,005,945 | A | 12/1999 | Whitehouse | |
| 6,047,273 | A | 4/2000 | Vaghi | |
| 6,064,981 | A | 5/2000 | Barni et al. | |
| 6,211,647 | B1 * | 4/2001 | Wendelrup et al. | 320/112 |
| 6,219,653 | B1 | 4/2001 | O'Neill et al. | |
| 6,233,568 | B1 | 5/2001 | Kara | |
| 6,249,777 | B1 | 6/2001 | Kara et al. | |
| 6,349,292 | B1 | 2/2002 | Sutherland et al. | |
| 6,385,731 | B2 | 5/2002 | Ananda | |
| 6,466,948 | B1 * | 10/2002 | Levitsky et al. | 1/1 |
| 6,567,794 | B1 | 5/2003 | Cordery et al. | |
| 6,718,350 | B1 * | 4/2004 | Karbowski | 707/695 |
| 6,920,429 | B1 | 7/2005 | Barni et al. | |

(Continued)

FOREIGN PATENT DOCUMENTS

| | | | |
|---|---|---|---|
| DE | 198 30 055 | 12/1999 | |
| WO | WO 2009/055385 A1 * | 4/2009 | G06F 17/00 |

OTHER PUBLICATIONS

Isaacs, Nathan, "New Rate Program Error Causes Lines at Some Post Offices," The Oregonian, Sunrise Edition, Portland, Oregon, Jan. 9, 2001, B02.*

(Continued)

*Primary Examiner* — Nathan Erb
(74) *Attorney, Agent, or Firm* — Pillsbury Winthrop Shaw Pittman LLP

(57) ABSTRACT

The system and method described herein may securely disseminate and manage postal rate information, including discount or custom postal rates established in contractual agreements negotiated between a postal service and certain mailers, among other postal rate types. For example, the postal service may upload postal rates to a server associated with a postage vendor and optionally associate the postal rates with particular mailers. The postal service and/or postage vendor may then validate whether the postal rates were correctly uploaded, and the postage vendor may then enable applicable mailers to utilize the postal rates in response to validating that the postal rates were correctly uploaded. Additionally, the postage vendor may maintain records relating to postage transactions, which a mailer can use to support a request to negotiate the custom postal rates with the postal service and subsequently prove compliance with any terms and conditions associated therewith.

19 Claims, 4 Drawing Sheets

(56) References Cited

U.S. PATENT DOCUMENTS

| | | | | |
|---|---|---|---|---|
| 7,035,832 | B1 | 4/2006 | Kara | |
| 7,069,253 | B2 | 6/2006 | Leon | |
| 7,233,929 | B1 | 6/2007 | Lingle et al. | |
| 7,359,887 | B1 | 4/2008 | Hu et al. | |
| 7,433,849 | B2 | 10/2008 | Cordery et al. | |
| 7,664,651 | B1 | 2/2010 | Bennett et al. | |
| 7,711,950 | B2 | 5/2010 | Orbke et al. | |
| 7,752,141 | B1 | 7/2010 | Ogg et al. | |
| 7,756,794 | B2 | 7/2010 | Bjerre et al. | |
| 7,774,284 | B2 | 8/2010 | Williams et al. | |
| 7,783,557 | B2 | 8/2010 | Laurent et al. | |
| 2001/0034608 | A1 | 10/2001 | Gendreau | |
| 2002/0116318 | A1 | 8/2002 | Thomas et al. | |
| 2003/0046639 | A1* | 3/2003 | Fai et al. | 715/513 |
| 2003/0144972 | A1* | 7/2003 | Cordery et al. | 705/401 |
| 2003/0163331 | A1 | 8/2003 | Podgurny et al. | |
| 2006/0136492 | A1* | 6/2006 | Lin | 707/103 Y |
| 2006/0173799 | A1* | 8/2006 | Minnocci | 705/404 |
| 2008/0040144 | A1 | 2/2008 | Riggs et al. | |
| 2009/0037203 | A1 | 2/2009 | Gallagher et al. | |
| 2010/0131526 | A1* | 5/2010 | Sun et al. | 707/758 |
| 2010/0235267 | A1* | 9/2010 | Brookner et al. | 705/30 |

OTHER PUBLICATIONS

International Search Report and Written Opinion as issued for International Application No. PCT/US2012/054196,dated Jan. 2, 2013.

Domestic Mail Manual, The United States Postal Service, Issue 58, Chapter G911—General Requirements for NSAs, Dec. 9, 2004, pp. 451-452.

"Information-Based Indicia Program (IBIP)—Performance Criteria for Information-Based Indicia and Security Architecture for Open IBI Postage Evidencing Systems (PCIBI-O)", The United States Postal Service, Feb. 23, 2000, 79 pages.

* cited by examiner

SYSTEM AND METHOD FOR SECURELY DISSEMINATING AND MANAGING POSTAL RATES

FIELD OF THE INVENTION

The invention generally relates to a system and method for securely disseminating and managing postal rates, and in particular, to secure mechanisms to disseminate and manage postal rate information, including discount or other custom postal rates that may be negotiated between a postal service and certain mailers, validate that the postal rate information was properly disseminated, enable clients to utilize the disseminated postal rate information, and maintain records relating to postage transactions that mailers can use to prepare documentation supporting requests to initiate negotiations with the postal service to obtain the discount or other custom postal rates and subsequently prove compliance with any terms and conditions associated with the discount or other custom postal rates.

BACKGROUND OF THE INVENTION

Various online postage vendors, including Endicia™ Internet Postage, generally enable Internet users to purchase United States postage and apply individual postage indicia to a wide spectrum of envelopes and labels using standard computer printers. These systems tend to be based on the concept of Information Based Indicia ("IBI"), which typically include information to uniquely identify a particular postage indicium. In particular, several years ago the United States Postal Service (USPS) began to investigate the feasibility of computer-based postage and eventually published requirements associated with Information Based Indicia in a document entitled "Information Based Indicium Program (IBIP)—Performance Criteria For Information-Based Indicia and Security Architecture for Open IBI Postage Evidencing Systems (PCIBI-O)," the contents of which are hereby incorporated by reference in their entirety. Following the USPS publishing the requirements associated with Information Based Indicia, various different architectures to support computer-based postage have evolved.

In particular, one computer-based postage architecture that has evolved to support computer-based postage relates to distributed postage indicia generation systems (e.g., as described in U.S. patent application Ser. No. 07/748,823, entitled "System and Method for Purchase and Application of Postage Using Personal Computer," filed Aug. 22, 1991, which issued as U.S. Pat. No. 5,319,562 on Jun. 7, 1994, the contents of which are hereby incorporated by reference in their entirety). In the distributed postage indicia architecture, a customer will typically purchase postage from the USPS or a postal vendor in lump sums that typically range from fifty to several thousand dollars, and the customer then downloads the postage to a Postal Security Device (PSD), which may alternatively be referred to herein as a postage meter, at the customer's location. The lump sum amount associated with the purchased postage will then be added to any balance remaining in the postage meter and the customer can then draw from the balance in the postage meter to produce postage indicia that can be printed and affixed to mail pieces. In response to the customer individually creating and metering the postage indicia to be affixed to the mail pieces, the balance in the postage meter will then be decremented according to the transaction amount associated with the postage indicia (e.g., the first class stamp rate, which currently stands at forty-four cents). Another architecture that has evolved to support computer-based postage relates to centralized postage indicia generation systems (e.g., as described in U.S. patent application Ser. No. 08/820,861, entitled "System and Method for Dispensing Postage Based on Telephonic or Web Milli-Transactions," filed Mar. 20, 1997, which issued as U.S. Pat. No. 6,005,945 on Dec. 21, 1999, the contents of which are hereby incorporated by reference in their entirety). In this architecture, the USPS or postal vendor securely maintains an account associated with the customer in a postage-issuing computer system, wherein the customer then contacts the postage-issuing computer system to purchase and create the postage (or IBI) to print and affix to mail pieces.

For example, FIG. 1 illustrates an exemplary front view associated with a mail piece 100 having an information-based postage indicia printed or otherwise affixed thereto, wherein the mail piece 100 shown in FIG. 1 may be appropriately created and printed in either the distributed architecture or the centralized architecture described above. In particular, the mail piece 100 generally comprises an envelope 102 with various items printed thereon, including a postage indicium 104, which in layperson terms may alternatively be referred to simply as a "stamp." The postage indicium 104, which a computer printer may generally print on the mail piece 100 in an upper right hand corner of the envelope 102, may generally comprise a barcode 106 that contains data relating to the mail piece 100 and the account holder in addition to human-readable information 108 (e.g., amount, service class, account number, etc.). Further, Facing Identification Marks (FIM) 110 that the USPS uses to initially sort the mail piece 100 may be located above and to the left of the postage indicium 104, and a return address 112 and destination address 114 may be printed on the envelope 102. A POSTNET™ barcode 116 may be located beneath the destination address 114 to encode a destination ZIP code or other delivery information that the USPS references to assist in directing mail.

More recently, computer-based postage architectures have increased the convenience associated with managing postage, especially for high-volume shippers that send large amounts of mail through the USPS and other postal services. Correlatively, industries with high shipping volumes such as the electronic commerce industry have contributed to substantial growth in the popularity associated with services that online postage vendors provide to efficiently and cost-effectively support high volumes of shipping transactions. For example, online postage vendors enable shippers to purchase and print virtually unlimited quantities of postage indicia and shipping labels on immediate request, which allows high-volume shippers to rapidly fulfill product orders without having to purchase often-expensive postage metering hardware. However, one problem that has arisen in computer-based postage architectures relates to securely managing discount rates that the USPS or other postal services negotiate with certain high-volume shippers. In particular, like many other businesses, the USPS offers programs to negotiate discounted contract rates, with high-volume customers. For example, these programs include Negotiated Service Agreements that stipulate custom pricing, rates, and classifications negotiated between the USPS and certain customers and Global Expedited Package Services (GEPS) agreements that similarly stipulate custom terms and conditions negotiated between the USPS and certain Express Mail International and Priority Mail International customers. These Negotiated Service Agreements and GEPS agreements tend to be extremely confidential in nature because disclosure to private shipping companies or other USPS competitors could materially harm USPS business and the negotiations typically require the customers to disclose substantial information about their internal operations, among other things.

For example, a customer seeking to enter into a Negotiated Service Agreement (NSA) with the USPS must initially submit a written proposal that includes appropriate supporting documentation, reasons for requesting the NSA, and information addressing applicable candidate features and general NSA requirements. Moreover, before the USPS will even consider entering into any substantive discussions relating to the proposal, the requesting customer must sign a nondisclosure agreement. Further detail describing the requirements, procedures, and conditions associated with Negotiated Service Agreements may be found in the USPS Domestic Mail Manual—Chapter G911, entitled "General Requirements for NSAs," the contents of which are hereby incorporated by reference in their entirety. Once the USPS and the requesting customer have agreed upon the custom rates to be stipulated in the NSA, the USPS then disseminates the custom rates to postage vendors or other postage service providers that then implement the negotiated rates. Historically, this dissemination process has involved the USPS either mailing the postage service provider an electronic media with the negotiated rates or sending the postage service provider an electronic mail message with the negotiated rates. However, the former transmission process tends to be vulnerable to physical attack or interception, while the latter transmission process tends to be vulnerable to electronic attack or interception. Moreover, rendering the negotiated rates to an electronic form tends to require potentially expensive manual labor and potentially error-prone human involvement at both the USPS and the postage service provider's locations.

Accordingly, the existing techniques that are typically used to disseminate postal rate information tend to fall short in suitably preventing security breaches relating to confidentially negotiated postal rates. Furthermore, because the existing processes used to disseminate postal rate information tend to be insecure, expensive, and susceptible to human error, better techniques to disseminate, update, and otherwise manage postal rates would provide substantial benefits to any mailers that enlist online postage vendors to purchase postage. However, existing systems typically lack adequate mechanisms to ensure that mailers are using the most current postal rate information, which could results in mailers having their shipments delayed or returned if the postage affixed thereto does not reflect the current postal rates, online postage vendors losing revenue due to customer dissatisfaction, and administrative hassles throughout the shipping chain, among other consequences.

SUMMARY OF THE INVENTION

According to one aspect of the invention, the system and method described herein may securely disseminate and manage postal rates. In particular, the system and method described herein may generally provide secure mechanisms to disseminate information relating to discount or other custom postal rates negotiated between a postal service (e.g., the United States Postal Service) and certain mailers. For example, a mailer may submit an initial proposal seeking custom postal rates to the postal service prior to the mailer and the postal service entering into substantive discussions to establish a contractual arrangement that provides the mailer with discount or other custom postal rates. As such, once the postal service and the mailer agree upon appropriate terms and conditions and enter into the contractual arrangement, the postal service may use the system and method described herein to transmit information relating to the discount or other custom postal rates to a postage vendor, wherein the postage vendor may then link the negotiated postal rate information to the associated mailer. The mailer may then communicate with the postage vendor to utilize the negotiated postal rates, whereby the negotiated postal rate information may be securely disseminated from the postal service to the postage vendor, and from the postage vendor to the mailer, without the postal service or the postage vendor having to render the negotiated postal rate information to any alternate media that may be susceptible to physical or electronic attack.

According to one aspect of the invention, the system and method described herein may supply the postal service with a rate upload interface that may be used to upload one or more files that contain discounted or other custom postal rates negotiated between the postal service and certain mailers. In one implementation, the rate upload interface may provide a web-based interface or any other interface that can suitably provide secure communications between a computer system associated with the postage vendor and a computer system associated with the postal service. Further, communications between the postage vendor computer system and the postal service computer system may be secured using the Secure Sockets Layer (SSL) protocol, which generally employs symmetric cryptography and keyed message authentication codes to encrypt network connection segments, ensure privacy, and ensure message reliability. Accordingly, the postal service may use the rate upload interface to securely and directly upload files that contain discount or other custom postal rates negotiated with certain mailers to the postage vendor computer system.

According to one aspect of the invention, the rate upload interface may generally enable the postal service to securely and directly upload the files that contain the discount or other custom postal rates to the postage vendor computer system. In particular, one or more human operators may utilize the rate upload interface to upload the files with the custom postal rates to the postage vendor computer system, or the postal service computer system may automatically upload the custom postal rate files to the postage vendor computer system. For example, the postage vendor may provide pre-approved authentication credentials to the postal service, which may be used to access the postage vendor computer system via the rate upload interface. As such, the rate upload interface may be utilized to establish a secure session with the postage vendor computer system, select one or more rate files to upload to the postage vendor computer system, and identify a particular mailer associated with the selected rate files. The selected rate files and the information that identifies the mailer may then be transmitted to the postage vendor computer system, wherein the rate files uploaded to the postage vendor computer system may generally include one or more comma-separated values that represent the custom postal rates associated with the identified mailer. Further, the information that identifies the associated mailer may include a code that uniquely identifies the mailer and ensures that the identified mailer's privacy will be protected should any messages in the transmission that uploads the rate files to the postage vendor computer system be intercepted or otherwise attacked. Moreover, the code may be encrypted within the messages that transmit the mailer identity to the postage vendor computer system to ensure that the mailer's identity and the associated custom postal rates will remain private.

According to one aspect of the invention, in response to the postal service computer system suitably uploading the rate files and the identity associated with the mailer, the postage vendor computer system may then locally store the uploaded rate files. In response to locally storing the uploaded rate files, the postage vendor computer system may then launch a validation engine, which may validate the contents associated with the uploaded rate files. For example, the validation engine may parse the contents associated with the uploaded rate files into the one or more comma-separated values or other data fields that represent the custom postal rates contained therein. In response to determining that the uploaded rate files could not be properly parsed, the validation engine may then send a message to the postal service computer system to indicate that an error occurred, and the postal service computer system may then notify one or more human operators or automated systems that further action may be needed to properly upload the rate files to the postage vendor computer system. Alternatively, in response to determining that the uploaded rate files were successfully parsed and validated into the custom postal rates, the validation engine may generate a display that compares the original rate files uploaded via the rate upload interface with the custom postal rates parsed from the uploaded rate files.

According to one aspect of the invention, to generate the display that compares the originally uploaded rate files to the parsed custom postal rates, the validation engine may load a rate acceptance interface in response to validating the uploaded rate files, wherein the rate acceptance interface may generate a web page or another suitable data structure (e.g., an XML file) to display the comparison between the originally uploaded rate files and the parsed custom postal rates. For example, in one implementation, the web page or other suitable data structure may include a side-by-side comparison between the originally uploaded rate files and the custom postal rates received at the postage vendor computer system, and the display that the rate acceptance interface shows to provide the comparison may then be viewed at the postal service computer system via the web-based rate upload interface to enable the postal service to authenticate that the custom postal rates received at the postage vendor computer system are identical to the custom postal rates that were uploaded. For example, the rate upload interface may provide the postal service with choices to either approve or reject the transmission associated with the uploaded rate files (e.g., an operator viewing the comparison may approve the transmission if the uploaded rate files and the parsed custom postal rates are identical, or alternatively reject the transmission if the uploaded rate files and the parsed custom postal rates have any discrepancies). In response to verifying that the uploaded rate files and the custom postal rates received at the postage vendor computer system 200 are identical, the transmission may be approved and a message may be automatically transmitted to the postage vendor computer system (i.e., to inform the postage vendor that the new rate files have been successfully uploaded). As such, the postage vendor computer system may then link the new rate files to an account that the postage vendor computer system maintains for the associated mailer based on the identity information that the postal service computer system previously provided when the rate files were uploaded. The postage vendor computer system may then enable the mailer to utilize the custom postal rates contained therein.

According to one aspect of the invention, to utilize the custom postal rates, the mailer may have a client computer that can communicate with the postage vendor computer system over a network, and the postage vendor may supply a postage application that the mailer can install on the client computer. As such, the mailer may load the postage application to establish a secure session with the postage vendor computer system and communicate with the postage vendor computer system to determine whether the postage vendor computer system has any newly available rate files or rate tables associated with the mailer. For example, the mailer may provide authentication credentials to the postage vendor computer system via the postage application, and the postage vendor computer system may determine an account or other identity associated with the mailer from the authentication credentials. The postage vendor computer system may then query one or more local data sources with the account or other identity to determine whether any new rate files or rate tables associated with the mailer have been added thereto and enable the mailer to use any such new rate files or rate tables. Further, the mailer may appropriately use the new rate files or rate tables in the distributed or centralized postage indicia generation architectures described above. For example, in the distributed architecture, the mailer may download the new rate files or rate tables to a rate data source or a postage meter that resides at the mailer's location, whereby the mailer may draw from the balance in the postage meter to produce postage indicia according to the custom postal rates in the downloaded rate files or tables. In the centralized architecture, the mailer may use the postage application to communicate with a postage engine running on the postage vendor computer system, wherein the postage engine may create postage indicia at the custom rate and deliver information that the postage application can use to print the postage indicia through a printer that resides at the mailer's location.

According to one aspect of the invention, utilizing the centralized postage indicia generation architecture to generate and print the postage indicia may provide the mailer with various advantages in developing the written proposal that the postal service requires to enter into substantive discussions on the contractual agreement and subsequently ensuring that the mailer complies with the terms and conditions that the mailer and the postal service eventually establish in the contractual agreement. For example, in response to the mailer contacting the postage vendor computer system to request and purchase postage from the postage vendor, the postage vendor computer system may automatically create records and store that describe transactions associated with the purchased postage. As such, the postage vendor may provide the mailer with information relating to the mailing and postage payment systems that the mailer currently uses, the mail volumes and specific mail services or mailpiece characteristics that the mailer has historically employed, and various other information that the mailer can use to prepare the documentation needed to support the initial proposal. Moreover, because the postage vendor may have a trusted relationship with the postal service, the postage vendor may provide the mailer with documentation that establishes the mailer's ability to accurately forecast future mail volumes and maintain quality control programs to facilitate monitoring compliance with any terms and conditions established in the contractual agreement associated with the mailer.

According to one aspect of the invention, in addition to disseminating and managing discount, negotiated, or other custom postal rates that apply to specific mailers, the system and method described herein may be used to disseminate and manage other suitable postal rates in the same or a substantially similar manner. For example, the system and method described herein may be used to disseminate and manage information relating to various public postal rate types, including commercial base pricing, commercial plus pricing, retail pricing, cubic volume pricing, or any suitable combination or modification thereof. As such, to the extent that any description provided above or herein refers to discount, negotiated, or other custom postal rates, such description may be applied to disseminate, update, or otherwise manage public postal rates in the same or a substantially similar manner. However, in scenarios where public postal rates are disseminated, updated, or otherwise managed, the public postal rates may not necessarily have an association with specific mailers. Rather, depending on the type associated with the public postal rates managed with the system and method described herein, the public postal rates may be associated with any suitable mailer, mailers grouped in a particular classification, or mailers having a particular customer status, as appropriate.

Other objects and advantages of the invention will be apparent to those skilled in the art based on the following drawings and detailed description.

DETAILED DESCRIPTION

Figure 1:
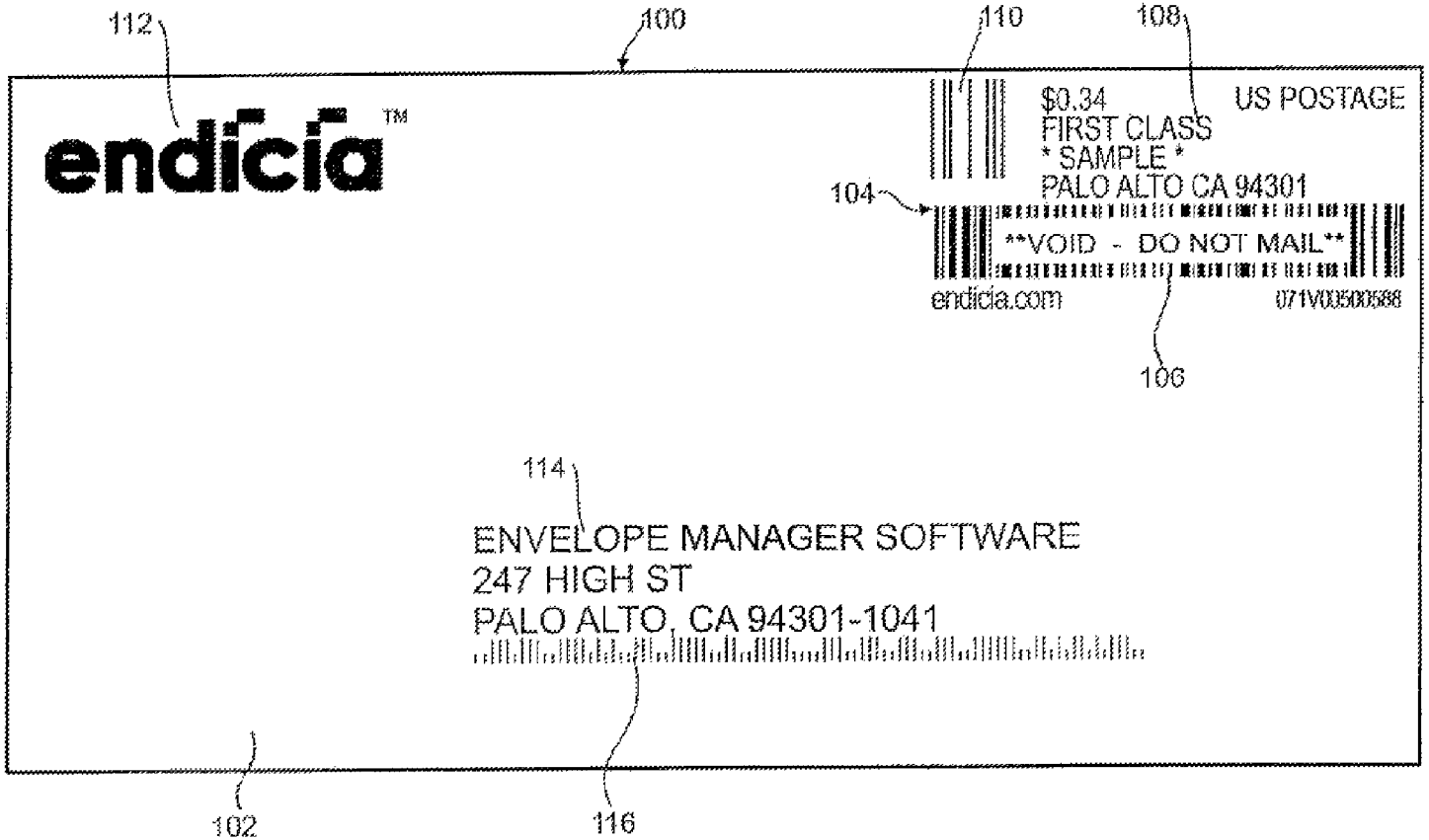
FIG. 1 illustrates an exemplary front view associated with a mail piece having an information-based postage indicia affixed thereto, according to one aspect of the invention.
Figure 2:
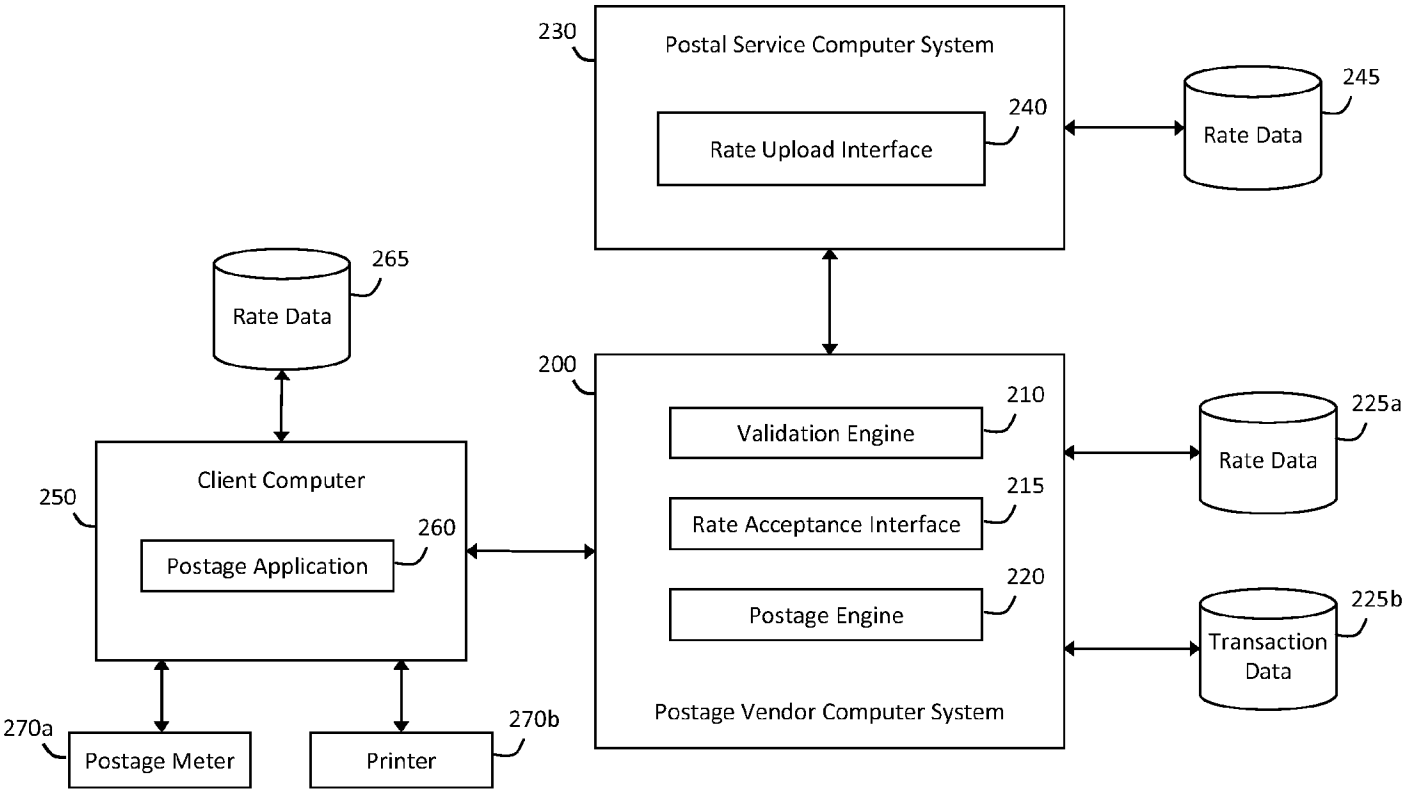
FIG. 2 illustrates an exemplary system for securely disseminating and managing postal rates, according to one aspect of the invention.

According to one aspect of the invention, FIG. 2 illustrates an exemplary system for securely disseminating and managing postal rates. In particular, the system shown in FIG. 2 may generally provide secure mechanisms to disseminate information relating to discount or other custom postal rates negotiated between a postal service (e.g., the United States Postal Service) and certain mailers or other customers associated with the postal service. For example, the postal service may negotiate the discount or other custom postal rates with the mailers pursuant to the "General Requirements for NSAs" guidelines, published in the USPS Domestic Mail. Manual, which was incorporated by reference above. In particular, as described in further detail therein, a mailer seeking discounted or other custom postal rates may initially submit a written proposal having appropriate supporting documentation to the postal service. Once the mailer executes a non-disclosure agreement, the mailer, and the postal service may then enter into substantive discussions to establish a contractual arrangement (e.g., a Negotiated Service Agreement) that defines the discount or other custom postal rates, quality control programs to ensure that the mailer complies with any terms and conditions established in the contractual agreement, or any other provisions that may suitably control the contractual arrangement negotiated between the mailer and the postal service. As such, in one implementation, once the postal service and the mailer agree upon the appropriate terms and conditions and enter, into the negotiated contractual arrangement, the postal service may use the system shown in FIG. 2 to transmit information relating to the discount or other custom postal rates negotiated therein to a postage vendor, wherein the postage vendor may then link the negotiated postal rate information to the associated mailer. In one implementation, the mailer may then communicate with the postage vendor to utilize the negotiated postal rates, whereby the negotiated postal rate information may be securely disseminated from the postal service to the postage vendor, and from the postage vendor to the mailer, without the postal service or the postage vendor having to render the negotiated postal rate information to any alternate media that may be susceptible to physical or electronic attack.

In one implementation, the system may generally include, among other things, a postage vendor computer system 200 that the postage vendor operates and a postal service computer system 230 that the postal service operates, wherein the postage vendor computer system 200 and the postal service computer system 230 may securely communicate over a network. For example, in one implementation, the postal service may operate a rate upload interface 240 associated with the postal service computer system 230 to upload one or more files that contain discounted or other custom postal rates negotiated between the postal service and certain mailers. In one implementation, the rate upload interface 240 may provide a web-based interface from the postal service computer system 230 to the postage vendor computer system 200, or the rate upload interface 240 may include any other interface that can suitably provide secure communications between the postage vendor computer system 200 and the postal service computer system 230. Further, in one implementation, the postage vendor computer system 200 and the postal service computer system 230 may communicate using the Secure Sockets Layer (SSL) protocol, which generally employs symmetric cryptography and keyed message authentication codes to encrypt network connection segments, ensure privacy, and ensure message reliability. Accordingly, as will be described in further detail herein, the postal service may use the rate upload interface 240 to securely and directly upload files that contain discount or other custom postal rates negotiated with certain mailers to the postage vendor computer system 200.

In one implementation, the rate upload interface 240 may generally include various features to enable the postal service to securely and directly upload the files that contain the discount or other custom postal rates to the postage vendor computer system 200. Further, one or more human operators may utilize the rate upload interface 240 to upload the files with the custom postal rates to the postage vendor computer system 200, or the postal service computer system 230 may alternatively upload the custom postal rate files to the postage vendor computer system 200 automatically. For example, in one implementation, the postage vendor may provide pre-approved authentication credentials (e.g., a user name and password) to the postal service, wherein the pre-approved authentication credentials may be used to access the postage vendor computer system 200 via the rate upload interface 240. As such, where a human operator utilizes the rate upload interface 240, an administrator or other user having appropriate authorization may provide the pre-approved authentication credentials to the postage vendor computer system 200, which may establish a secure session (e.g., an SSL session) with the postal service computer system 230 in response to validating the authentication credentials. The operator utilizing the rate upload interface 240 may then select one or more rate files stored in a rate data source 245 to upload to the postage vendor computer system 200, wherein a particular mailer associated with the selected rate files may optionally be identified. As such, the selected rate files and information that identifies the mailer may then be transmitted to the postage vendor computer system 200. Alternatively, to automatically upload the custom postal rate files to the postage vendor computer system 200, the postal service computer system 230 may similarly provide authentication credentials, select the rate files to be uploaded, and identify the associated mailer, except without substantial human intervention (e.g., the rate upload interface 240 may be automatically launched to upload one or more rate files that have been newly added to the rate data source 245).

In one implementation, the rate files uploaded from the postal service computer system 230 to the postage vendor computer system 200 may generally include one or more comma-separated values that represent the custom postal rates associated with the identified mailer, or the uploaded rate files may encoded in any other suitable format that enables the postage vendor computer system 200 to parse or otherwise use the custom postal rates represented therein. Furthermore, in one implementation, the information that identifies the associated mailer may include a code that uniquely identifies the mailer and ensures that the identified mailer's privacy will be protected should any messages in the transmission that uploads the rate files to the postage vendor computer system 200 be intercepted or otherwise attacked. For example, the code may include an account number uniquely associated with the mailer, a string that uniquely identifies the mailer, or any other suitable information that uniquely identifies the mailer. Moreover, in one implementation, the code may be encrypted within the messages that transmit the mailer identity to the postage vendor computer system 200 to ensure that the mailer's identity and the associated custom postal rates will remain private.

In one implementation, in response to the postal service computer system 230 suitably uploading the rate files and the identity associated with the mailer, the postage vendor computer system 200 may then store the uploaded rate files in a local rate data source 225*a*. Further, in one implementation, the uploaded rate files may be temporarily stored in the local rate data source 225*a* until the postal service computer system 230 validates that the rate files were correctly uploaded (e.g., the uploaded rate files may be moved from temporary storage to persistent storage in response to the postal service computer system 230 subsequently validating that the rate files were correctly uploaded, or the uploaded rate files may be removed from the local rate data source 225*a* in response to the postal service computer system 230 indicating that the rate files were incorrectly uploaded). In response to suitably storing the uploaded rate files in the local rate data source 225*a*, the postage vendor computer system 200 may then launch a validation engine 210, which may include one or more processors configured to validate the contents associated with the uploaded rate files. For example, the validation engine 210 may be configured to parse the contents associated with the uploaded rate files into one or more comma-separated values or other data fields that represent the custom postal rates contained therein. As such, in response to determining that the uploaded rate files could not be properly parsed, the validation engine 210 may send a message indicating that an error occurred to the postal service computer system 230 (e.g., via the rate upload interface 240), whereby the postal service computer system 230 may notify one or more human operators or automated systems that further action may be needed to properly upload the rate files to the postage vendor computer system 200.

Alternatively, in response to the validation engine 210 determining that the uploaded rate files were successfully parsed and validated into the comma-separated values or other data fields that represent the custom postal rates contained therein, the validation engine 210 may generate a display that compares the original rate files uploaded from the postal service computer system 230 via the rate upload interface 240 with the custom postal rates parsed from the uploaded rate files. In one implementation, the validation engine 210 may load a rate acceptance interface 215 in response to validating that the uploaded rate files were successfully parsed or otherwise processed, wherein the rate acceptance interface 215 may generate a web page or another suitable data structure (e.g., an XML file) to display the comparison between the original rate files uploaded to the postage vendor computer system 200 and the custom postal rates parsed therefrom. For example, in one implementation, the web page or other suitable data structure may include a side-by-side comparison between the originally uploaded rate files and the custom postal rates that the postage vendor computer system 200 parsed from the uploaded rate files. As such, the display that the rate acceptance interface 215 shows to provide the comparison between the originally uploaded rate files and the custom postal rates parsed therefrom may then be viewed at the postal service computer system 230 via the web-based rate upload interface 240, which may enable the postal service to authenticate that the custom postal rates received at the postage vendor computer system 200 are an identical match to the custom postal rates that were uploaded.

For example, in one implementation, the rate upload interface 240 may include one or more buttons or other user interface elements that provide the postal service with a choice to either approve or reject the transmission associated with the uploaded rate files. In particular, an administrator or other authorized human operator may view the comparison between the uploaded rate files and the parsed custom postal rates and choose to approve the transmission if the uploaded rate files and the parsed custom postal rates are identical, or the operator may alternatively reject the transmission if the uploaded rate files and the parsed custom postal rates have any discrepancies. Alternatively (or additionally), the rate upload interface 240 may be configured to automatically review the comparison between the uploaded rate files and the parsed custom postal rates (e.g., the rate upload interface 240 may analyze various data fields in the display to determine whether any discrepancies exist, automatically approve the transmission if no discrepancies are found, notify an appropriate human operator that appropriate remedial action may be needed if any discrepancies are found, etc.). However, in certain implementations, the rate upload interface 240 may be configured to require that only a human operator can approve or reject the transmission to ensure that no machine errors occurred, or the rate upload interface 240 may be configured to require combined human and automated review to provide additional protection from human and machine errors.

In one implementation, in response to verifying that the uploaded rate files and the custom postal rates received at the postage vendor computer system 200 are identical and suitably approving the transmission, the rate upload interface 240 may then automatically send a message (e.g., an e-mail message) to inform the postage vendor computer system 200 that the new rate files have been successfully uploaded. As such, the postage vendor computer system 200 may then persistently store the uploaded rate files in the local data store 225*a*, and if the new rate files are associated with a specific mailer, the postage vendor computer system 200 may further link the new rate files to an account that the postage vendor computer system 200 maintains for the associated mailer. In particular, the postage vendor computer system 200 may reference any identity information that the postal service computer system 230 may have provided when the rate files were previously uploaded to determine an account associated with such identity information. Accordingly, in response to persistently storing the new rate files in the local data store 225*a* and linking the new rate files to the account maintained for the associated mailer, the postage vendor computer system 200 may then enable the mailer to utilize the custom postal rates contained therein.

For example, in one implementation, the mailer may generally have a client computer 250 that can communicate with the postage vendor computer system 200 over a network, and the postage vendor may supply a postage application 260 that the mailer can install on the client computer 250. As such, to utilize the custom postal rates uploaded from the postal service computer system 230 to the postage vendor computer system 200, the mailer may load the postage application 260 to establish a secure session with the postage vendor computer system 200. In one implementation, the postage application 260 may then communicate with the postage vendor computer system 200 to determine whether the rate data source 225*a* has any new rate files or rate tables associated with the mailer. For example, the mailer may provide authentication credentials to the postage vendor computer system 200 via the postage application 260 in a similar manner as described above, wherein the postage vendor computer system 200 may determine an account or other identity associated with the mailer from the authentication credentials. The postage vendor computer system 200 may then query the local data source 225*a* with the account or other identity to determine whether any new rate files or rate tables associated with the mailer have been added thereto and enable the mailer to use any new rate files or rate tables associated with the mailer that have been added to the local data source 225*a*.

Further, in one implementation, the mailer may appropriately use the new rate files or rate tables in the distributed or centralized postage indicia generation architectures described above. For example, in the distributed architecture, the mailer may download the new rate files or rate tables to a rate data source 265 that resides at the mailer's location, or the new rate files or rate tables may be downloaded to a postage meter 270*a* that resides at the mailer's location. As such, in response to the mailer drawing from the balance in the postage meter 270*a* to produce postage indicia, the balance in the postage meter may then be decremented according to the custom postal rates defined in the downloaded rate files or tables. In the centralized architecture; the mailer may use the postage application 260 to communicate with a postage engine 220 running on the postage vendor computer system 200, wherein the postage engine 220 may create postage indicia at the custom rate and deliver information that the postage application 260 can use to print the postage indicia through a printer 270*b* that resides at the mailer's location. However, in certain implementations, utilizing the centralized postage indicia generation architecture to generate and print the postage indicia may provide the mailer with various advantages in developing the written proposal that the postal service requires to enter into substantive discussions on the contractual agreement and subsequently ensuring that the mailer complies with the terms and conditions that the mailer and the postal service eventually establish in the contractual agreement.

For example, the "General Requirements for NSAs" chapter in the USPS Domestic Mail Manual includes various provisions that relate to candidate factors and requirements that the postal service considers to evaluate a mailer's proposal that seeks custom postal rates. In particular, the postal service generally considers, among other things, the following candidate factors and requirements to evaluate a mailer's proposal that seeks custom postal rates:

1. Mailing systems, postage payment systems, and quality control procedures and programs that the mailer currently employs.
2. Mail volumes and specific mail services or mailpiece characteristics that the mailer has historically employed.
3. The mailer's ability to accurately forecast future mail volumes, collect data needed to support the contractual agreement, and willingness to establish and maintain electronic systems and quality control programs that can generate records to facilitate monitoring and reconciling mail volumes, rates, and fees, including volumes and postage that a mail preparation agent pays on behalf of the mailer.
4. Whether the mailer produces mail using a system that ensures proper mail preparation and accurate postage calculations.

In addition, to ensure that any contractual agreement does not have an overall negative financial impact on the postal service, the "General Requirements for NSAs" chapter in the USPS Domestic Mail Manual includes various further provisions that impose requirements to ensure that the postal service will be able to appropriately monitor, audit, or otherwise verify that the mailer complies with the terms and conditions in the contractual agreement. In particular, the postal service requires that the mailer will adhere to the following conditions to enable monitoring, auditing, or otherwise verifying compliance with the contractual agreement:

1. The mailer must permit the postal service to inspect mail content to determine rate eligibility and prepare mail under currently applicable mailing standards, unless the contractual agreement provides otherwise.
2. The mailer must meet and adhere to quality management standards associated with the mail and rate classes that the mailer claims and make necessary records and data related to the contractual agreement available to the postal service in a form that facilitates monitoring compliance with the terms and conditions.

Accordingly, the centralized postage indicia generation architecture may provide various advantages in developing the initial written proposal that must be submitted to the postal service requires and subsequently ensuring compliance with any terms and conditions that may be established in the contractual agreement. For example, in response to the mailer contacting the postage engine 220 to request and purchase postage from the postage vendor computer system 200, the postage engine 220 may automatically create records to describe transactions associated with the purchased postage, which may be stored in a transaction data source 225*b*. As such, the postage vendor may provide the mailer with information relating to the mailing and postage payment systems that the mailer currently uses and the mail volumes and specific mail services or mailpiece characteristics that the mailer has historically employed, wherein the mailer may use such information to prepare the documentation needed to support the initial proposal. Moreover, because the postage vendor may have a trusted relationship with the postal service, the postage vendor may provide the mailer with documentation that establishes the mailer's ability to accurately forecast future mail volumes, maintain electronic systems and quality control programs that can generate records to monitor and reconcile mail information, and use a system that ensures proper mail preparation and accurate postage calculations. Further, in response to the postal service uploading custom postal rates to the postage vendor computer system 200, the postage vendor may continue to generate and store, records in the transaction data source 225*b* that can be made available to the postal service in a form that facilitates monitoring compliance with the terms and conditions.

Furthermore, in one implementation, the system shown in FIG. 2 may be used to disseminate and manage public postal rates in the same or a substantially similar manner to the discount, negotiated, or custom postal rates. For example, the postal service computer system 230 may be used to disseminate information in the rate data source 245 that relates to public postal rate types, including commercial base pricing, commercial plus pricing, retail pricing, cubic volume pricing, or any suitable combination or modification thereof. As such, public postal rates may be uploaded, validated, and associated with applicable clients in the same or a substantially similar manner to the above description relating to how the system can manage discount, negotiated, or custom postal rates, except that the public postal rates may be associated with any suitable mailer, mailers grouped in a particular classification, or mailers having a particular customer status, depending on the type associated with the public postal rates as appropriate.

Figure 3:
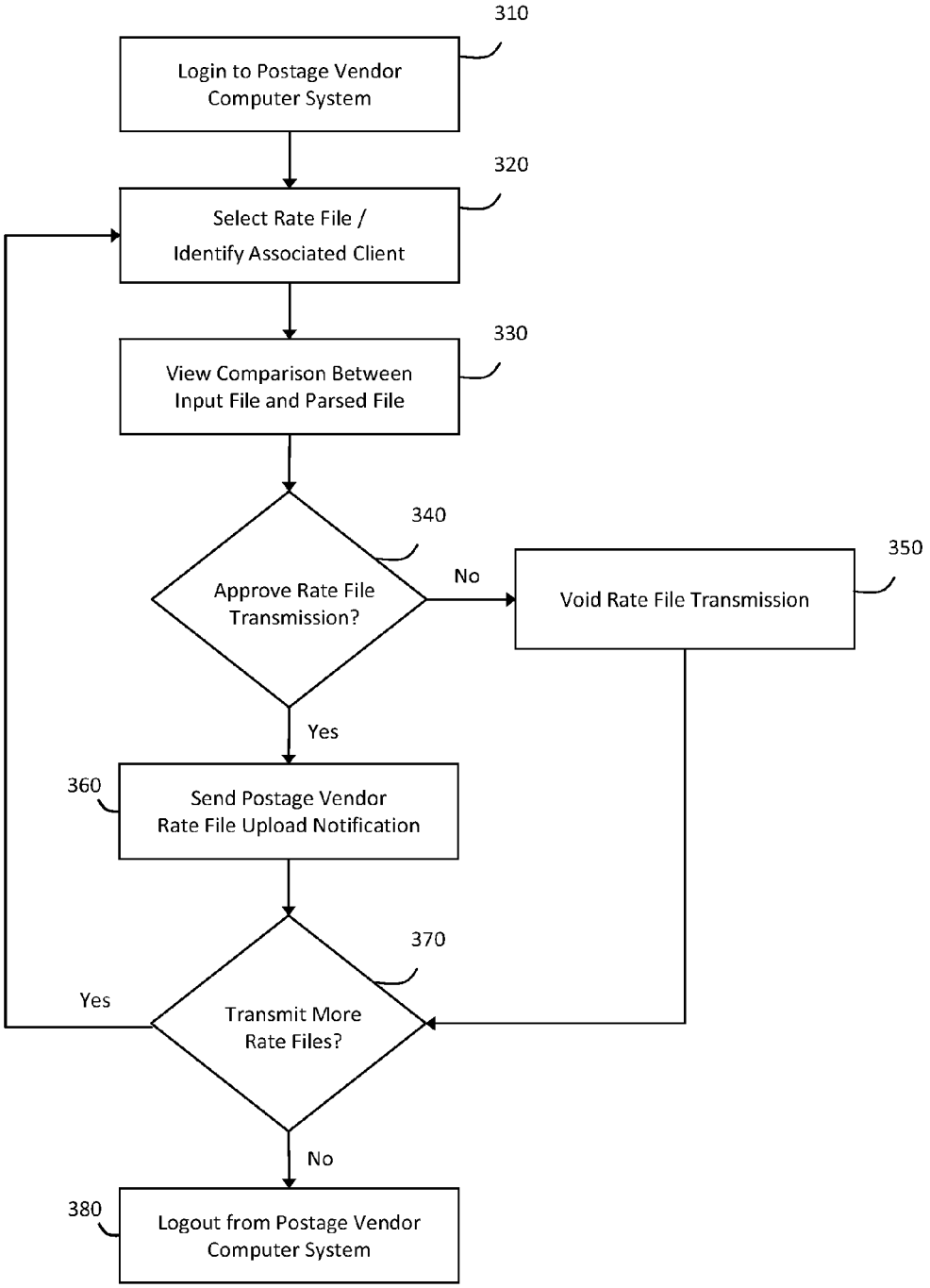
FIG. 3 illustrates an exemplary method in which a postal service securely disseminates postal rates to a postage vendor, according to one aspect of the invention.

According to one aspect of the invention, FIG. 3 illustrates an exemplary method in which a postal service securely disseminates postal rates to a postage vendor. In particular, the method illustrated in FIG. 3 may generally provide various secure mechanisms to disseminate information relating to discount or other custom postal rates negotiated between a postal service and certain mailers or other customers associated with the postal service. For example, in one implementation, the method may generally include the postal service transmitting information relating to discount or other custom postal rates negotiated in a contractual agreement with a particular mailer to a postage vendor, wherein the postage vendor may then link the negotiated postal rate information to the associated mailer. The mailer may then communicate with the postage vendor to utilize the negotiated postal rates, whereby the negotiated postal rate information may be securely disseminated from the postal service to the postage vendor, and from the postage vendor to the mailer, without the postal service or the postage vendor having to render the negotiated postal rate information to any alternate media that may be susceptible to physical or electronic attack.

In one implementation, the method shown in FIG. 3 may include the postal service operating a rate upload interface to upload one or more files that contain discounted or other custom postal rates negotiated between the postal service and certain mailers. In one implementation, the rate upload interface may provide a web-based interface to a computer system associated with the postage vendor, wherein a computer system associated with the postal service may run the rate upload interface to communicate with the postage vendor computer system using the SSL protocol. For example, in one implementation, the postage vendor may provide pre-approved authentication credentials (e.g., a user name and password) to the postal service, wherein an operation 310 may include logging the postal service into the postage vendor computer system in response to a human or automated operator utilizing the rate upload interface to provide the pre-approved authentication credentials to the postage vendor computer system. In one implementation, operation 310 may further include establishing a secure SSL session between the postal service computer system and the postage vendor computer system in response to validating the authentication credentials.

In one implementation, an operation 320 may then include the human or automated operator utilizing the rate upload interface to select one or more rate files stored in a client rate data source to upload to the postage vendor computer system. In addition, the human or automated operator utilizing the rate upload interface may optionally identify a particular mailer associated with the selected rate files. As such, the selected rate files and any information to optionally identify the mailer may then be transmitted to the postage vendor computer system, wherein the rate files uploaded to the postage vendor computer system may generally include one or more comma-separated values that represent the custom postal rates and any identified mailer associated therewith. In one implementation, if the operator provides information to identify the mailer in operation 320, such information may include a code to uniquely identify the mailer and thereby ensure that the mailer's privacy will be protected should any messages uploading the rate files to the postage vendor computer system be intercepted or otherwise attacked. Moreover, in one implementation, the code may be encrypted within the messages that upload the mailer identity to the postage vendor computer system to ensure that the mailer's identity and the associated custom postal rates will remain private. In one implementation, the postage vendor computer system may then locally store the uploaded rate files and validate the contents associated with the uploaded rate files. For example, a validation engine associated with the postage vendor computer system may parse the contents associated with the uploaded rate files into one or more comma-separated values or other data fields that represent the custom postal rates contained therein.

As such, in response to determining that the uploaded rate files were successfully parsed and validated into the custom postal rates contained therein, the validation engine may generate a display that compares the original rate files uploaded via the rate upload interface with the custom postal rates parsed from the uploaded rate files. In one implementation, the display may include a web page or other suitable data structure (e.g., an XML file) that compares the rate files originally uploaded to the postage vendor computer system with the custom postal rates that the postage vendor computer system parsed therefrom. For example, the web page or other suitable data structure may include a side-by-side comparison between the originally uploaded rate files and the custom postal rates that the postage vendor computer system parsed from the uploaded rate files, wherein the display that shows the comparison between the originally uploaded rate files and the custom postal rates parsed therefrom may then be viewed at the postal service computer system in an operation 330. Accordingly, the postal service may then authenticate that the custom postal rates parsed at the postage vendor computer system are identical to the custom postal rates that were uploaded.

For example, in one implementation, the rate upload interface may include one or more buttons or other user interface elements that provide the postal service with a choice to either approve or reject the transmission associated with the uploaded rate files. In particular, the comparison between the uploaded rate files and the parsed custom postal rates may be viewed in operation 330 and the postal service may then choose whether to approve or reject the transmission in an operation 340. In particular, the postal service may generally approve the transmission if the uploaded rate files and the parsed custom postal rates are identical, or alternatively reject the transmission if the uploaded rate files and the parsed custom postal rates have any discrepancies. In response to verifying that the uploaded rate files and the custom postal rates parsed at the postage vendor computer system are identical and suitably approving the transmission, an operation 360 may automatically send a message to the postage vendor to indicate that the new rate files were successfully uploaded. Alternatively, if the uploaded rate files and the custom postal rates parsed at the postage vendor computer system have any discrepancies, the postal service may reject the transmission in an operation 350.

In either case, an operation 370 may prompt the postal service to indicate whether any additional rate files will be uploaded. For example, if the transmission was rejected in operations 340 and 350, the postal service may indicate that additional rate files will be uploaded, wherein operation 370 may then return the method to operation 320 to enable the postal service to reattempt the transmission. Furthermore, even if the transmission was approved in operations 340 and 360, the postal service may choose to upload additional rate files in operation 370, in which case the method may similarly return to operation 320 to enable the postal service to attempt additional transmissions (e.g., to upload custom postal rates associated with additional mailers). In response to the postal service indicating that no more rate files remain to be uploaded, an operation 380 may then process a request to logout from the postage vendor computer system.

Figure 4:
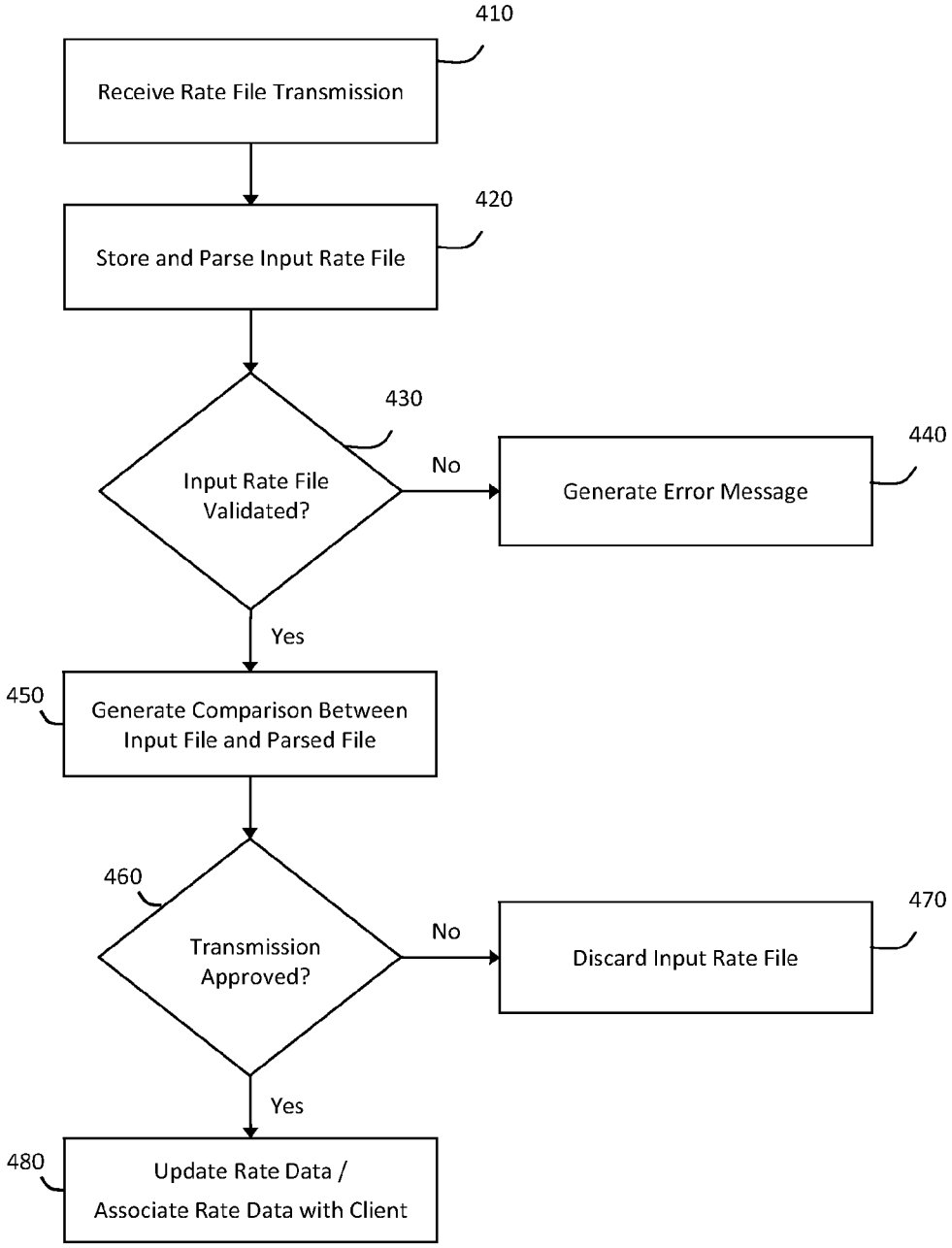
FIG. 4 illustrates an exemplary method in which a postage vendor receives and manages postal rates securely disseminated from a postal service, according to one aspect of the invention.

According to one aspect of the invention, FIG. 4 illustrates an exemplary method in which a postage vendor receives and manages postal rates securely disseminated from a postal service. In particular, the method illustrated in FIG. 4 may generally be performed in response to the postal service uploading one or more rate files that contain custom postal rates to the postage vendor, which may generally occur in a substantially similar manner as described above with reference to FIG. 3. For example, in one implementation, the postage vendor may receive one or more rate file transmissions from the postal service in an operation 410, wherein the postage vendor computer system may then locally store and parse the uploaded rate files in an operation 420. In one implementation, the uploaded rate files may be temporarily stored until the postal service suitably validates that the rate files were correctly uploaded, as will be described in further detail herein. In one implementation, in response to locally storing and parsing the uploaded rate files, an operation 430 may include the postage vendor computer system launching a validation engine to validate the contents associated with the uploaded rate files. For example, the validation engine may parse the contents associated with the uploaded rate files into one or more comma-separated values or other data fields that represent the custom postal rates contained therein. As such, in response to determining that the uploaded rate files could not be properly parsed or otherwise validated, the validation engine may send an error message to the postal service in an operation 440 to inform the postal service that further action may be needed to properly upload the rate files.

Alternatively, in response to the validation engine determining that the uploaded rate files were successfully parsed and validated into the comma-separated values or other data fields that represent the custom postal rates contained therein, an operation 450 may generate a display that compares the original rate files uploaded from the postal service with the custom postal rates parsed from the uploaded rate files. In one implementation, the display may include a web page or other suitable data structure (e.g., an XML file) that shows a side-by-side comparison between the originally uploaded rate files and the custom postal rates that the postage vendor computer system parsed from the uploaded rate files. As such, the display generated in operation 450 may then be viewed at the postal service via a web-based interface to enable the postal service to authenticate that the custom postal rates received at the postage vendor computer system are identical to the custom postal rates that were uploaded. For example, as described in further detail above with reference to FIGS. 2 and 3, the postal service may operate the web-based interface to view the display showing the comparison between the uploaded rate files and the parsed custom postal rates and approve or reject the transmission based on whether the uploaded rate files and the custom postal rates parsed at the postage vendor computer system are identical.

In one implementation, in response to the postal service determining that one or more discrepancies exist between the uploaded rate files and the custom postal rates parsed at the postage vendor computer system, the postal service may reject the transmission in operation 460, and the postage vendor computer system may then discard the input rate file in an operation 470. Alternatively, in response to the postal service verifying that the uploaded rate files and the custom postal rates parsed at the postage vendor computer system are identical and suitably approving the transmission, the postage vendor computer system may receive a message from the postal service indicating that new rate files have been uploaded. As such, an operation 480 may then include the postage vendor computer system persistently storing the uploaded rate files, and if the uploaded rate files were associated with a particular mailer, operation 480 may further include associating the new rate files with an account that the postage vendor computer system maintains for the associated mailer. In particular, the postage vendor computer system may reference any identity information that the postal service computer system may have provided when the rate files were previously uploaded to determine the account associated with the mailer and subsequently enable the mailer to utilize the custom postal rates contained therein. For example, in one implementation, enabling the mailer to utilize the custom postal rates in operation 480 may include downloading the new custom postal rates to a client computer associated with the mailer to be used in a distributed postage indicia generation architecture, or alternatively referencing the new custom postal rates to generate postage indicia on the mailer's behalf in a centralized postage indicia generation architecture, as described in further detail above with reference to FIG. 2. As such, the mailer may then use the new custom postal rates to generate and print all applicable postage, and the method shown in FIG. 4 may be similarly performed to process any subsequent rate files that the postal service may upload to the postage vendor computer system. Furthermore, if the uploaded rate files include public postal rates that are not associated with any specific individual mailer, operation 480 may include associating the uploaded public postal rates with any applicable mailers (e.g., if the uploaded postal rates relate to commercial base or commercial plus prices, operation 480 may associate the newly uploaded rates with any clients have a commercial bus or commercial plus customer status, as appropriate).

Implementations of the invention may be made in hardware, firmware, software, or various combinations thereof. The invention may also be implemented as instructions stored on a machine-readable medium, which may be read and executed using one or more processing devices. In one implementation, the machine-readable medium may include various mechanisms for storing and/or transmitting information in a form that can be read by a machine (e.g., a computing device). For example, a machine-readable storage medium may include read only memory, random access memory, magnetic disk storage media, optical storage media, flash memory devices, and other media for storing information, and a machine-readable transmission media may include forms of propagated signals, including carrier waves, infrared signals, digital signals, and other media for transmitting information. While firmware, software, routines, or instructions may be described in the above disclosure in terms of specific exemplary aspects and implementations performing certain actions, it will be apparent that such descriptions are merely for the sake of convenience and that such actions in fact result from computing devices, processing devices, processors, controllers, or other devices or machines executing the firmware, software, routines, or instructions.

Furthermore, aspects and implementations may be described in the above disclosure as including particular features, structures, or characteristics, but it will be apparent that every aspect or implementation may or may not necessarily include the particular features, structures, or characteristics. Further, where particular features, structures, or characteristics have been described in connection with a specific aspect or implementation, it will be understood that such features, structures, or characteristics may be included with other aspects or implementations, whether or not explicitly described. For example, as noted above, the system and method described above may be used to disseminate and manage public postal rates in the same or a substantially similar manner to discount, negotiated, or other custom postal rates that apply to specific mailers (e.g., public postal rates relating to commercial base pricing, commercial plus pricing, retail pricing, cubic volume pricing, etc.). As such, any description provided above that refers to discount, negotiated, or other custom postal rates may apply to public postal rates in the same or a substantially similar manner (e.g., depending on the type associated with the public postal rates, the public postal rates may be uploaded to the postage vendor computer system, appropriately validated, and associated with applicable mailers to enable using the newly uploaded postal rates, as appropriate). Thus, various changes and modifications may be made to the preceding disclosure without departing from the scope or spirit of the invention, and the specification and drawings should therefore be regarded as exemplary only, with the scope of the invention determined solely by the appended claims.

We claim:

1. A system for securely disseminating and managing postal rates comprising:

a postage vendor computer system having one or more processors;

wherein the one or more processors are configured to:

receive a transmission that includes one or more files containing custom postal rates from a postal service computer system, wherein the transmission further includes information that identifies a particular mailer associated with the custom postal rates;

parse the one or more files into one or more data fields, wherein the one or more data fields represent the custom postal rates associated with the mailer;

associate the custom postal rates with an account that the postage vendor computer system maintains for the mailer in response to the postal service computer system validating that the one or more data fields are identical to the custom postal rates; and enable the mailer to use the account that the postage vendor computer system maintains for the mailer to generate postage indicia at the custom postal rates.

2. The system of claim 1, wherein the one or more processors are further configured to:

generate a display that shows a side-by-side comparison between the one or more data fields parsed at the postage vendor computer system and the custom postal rates transmitted from the postal service computer system to the postage vendor computer system; and transmit the display to the postal service computer system, wherein the postal service computer system has an interface that enables the postal service to view the side-by-side comparison and validate whether the one or more data fields parsed at the postage vendor computer system are identical to the custom postal rates transmitted to the postage vendor computer system.

3. The system of claim 2, wherein the one or more processors are further configured to receive a message that approves the transmission from the postal service computer system in response to the postal service computer system validating that the one or more data fields parsed at the postage vendor computer system are identical to the custom postal rates transmitted to the postage vendor computer system.

4. The system of claim 3, wherein the one or more processors are further configured to store the custom postal rates associated with the mailer in a data source in response to receiving the message that approves the transmission from the postal service computer system, wherein the data source associates the stored custom postal rates with the account that the postage vendor computer system maintains for the mailer.

5. The system of claim 2, wherein the one or more processors are further configured to:

receive a message that rejects the transmission from the postal service computer system in response to the postal service computer system determining that one or more discrepancies exist between the one or more data fields parsed at the postage vendor computer system and the custom postal rates transmitted to the postage vendor computer system; and discard the one or more files in response to receiving the message that rejects the transmission from the postal service computer system.

6. The system of claim 1, wherein the one or more processors are further configured to:

process a request to login to the postage vendor computer system from a client computer associated with the mailer; and transmit the custom postal rates to the client computer associated with the mailer to enable the mailer to use the custom postal rates, wherein the mailer uses a local postage meter coupled to the client computer to generate the postage indicia at the custom postal rates.

7. The system of claim 1, wherein the one or more processors are further configured to:

generate a postage indicium in response to a postage request received from a client computer associated with the mailer, wherein the postage vendor computer system generates the postage indicium at the custom postal rates; and store transaction information associated with the generated postage indicium in a data source associated with the postage vendor computer system.

8. The system of claim 7, wherein the one or more processors are configured to store the transaction information associated with the generated postage indicium to facilitate the postal service computer system monitoring the mailer's compliance to one or more terms and conditions defined in a contractual agreement between the postal service and the mailer, wherein the contractual agreement establishes the custom postal rates associated with the mailer.

9. A method for securely disseminating postal rates, comprising:

receiving, by a postage vendor computer system, a transmission that includes one or more files containing custom postal rates from a postal service computer system, wherein the transmission further includes information that identifies a particular mailer associated with the custom postal rates;

parsing the one or more files into one or more data fields by the postage vendor computer system, wherein the one or more data fields parsed from the one or more files represent the custom postal rates associated with the mailer;

associating the custom postal rates with an account that the postage vendor computer system maintains for the mailer in response to the postal service computer system validating that the one or more data fields are identical to the custom postal rates; and enabling the mailer to use the account that the postage vendor computer system maintains for the mailer to generate postage indicia at the custom postal rates.

10. The method of claim 9, further comprising:

generating a display that shows a side-by-side comparison between the one or more data fields parsed at the postage vendor computer system and the custom postal rates transmitted from the postal service computer system to the postage vendor computer system; and transmitting the display to the postal service computer system, wherein the postal service computer system has an interface that enables the postal service to view the side-by-side comparison and validate whether the one or more data fields parsed at the postage vendor computer system are identical to the custom postal rates transmitted from the postal service computer system to the postage vendor computer system.

11. The method of claim 10, further comprising receiving a message that approves the transmission from the postal service computer system in response to the postal service computer system validating that the one or more data fields parsed at the postage vendor computer system are identical to the custom postal rates transmitted to the postage vendor computer system.

12. The method of claim 11, further comprising storing the custom postal rates associated with the mailer in a data source in response to receiving the message that approves the transmission from the postal service computer system, wherein the data source associates the stored custom postal rates with the account that the postage vendor computer system maintains for the mailer.

13. The method of claim 10, further comprising:

receiving a message that rejects the transmission from the postal service computer system in response to the postal service computer system determining that one or more discrepancies exist between the one or more data fields parsed at the postage vendor computer system and the custom postal rates transmitted to the postage vendor computer system; and discarding the one or more files in response to receiving the message that rejects the transmission from the postal service computer system.

14. The method of claim 9, further comprising:

processing a request to login to the postage vendor computer system from a client computer associated with the mailer; and transmitting the custom postal rates to the client computer associated with the mailer to enable the mailer to use the custom postal rates, wherein the mailer uses a local postage meter to generate the postage indicia at the custom postal rates.

15. The method of claim 9, further comprising:

generating a postage indicium in response to a postage request received from a client computer associated with the mailer, wherein the postage vendor computer system generates the postage indicium at the custom postal rates; and storing transaction information associated with the generated postage indicium in a data source associated with the postage vendor computer system.

16. The method of claim 15, further comprising storing the transaction information associated with the generated postage indicium to facilitate the postal service computer system monitoring the mailer's compliance to one or more terms and conditions defined in a contractual agreement between the postal service and the mailer, wherein the contractual agreement establishes the custom postal rates associated with the mailer.

17. A system for securely disseminating and managing postal rates comprising:

a postal service computer system having one or more processors;

wherein the one or more processors are configured to:

send a transmission that includes one or more files containing custom postal rates to a postage vendor computer system, wherein the transmission further includes information that identifies a particular mailer associated with the custom postal rates;

execute a comparison between one or more data fields that the postage vendor computer system identified in the one or more files and the custom postal rates sent in the transmission, wherein the one or more data fields represent the custom postal rates associated with the mailer;

determine whether the one or more data fields are identical to the custom postal rates transmitted to the postage vendor; and send to the postage vendor computer system an approval message if the one or more data fields are identical to the custom postal rates transmitted to the postage vendor, wherein the postage vendor enables the mailer to generate postage indicia at the custom postal rates in response to receiving the approval message.

18. The system of claim 17, wherein the one or more processors are further configured to send to the postage vendor computer system a rejection message if one or more discrepancies exist between the one or more data fields identified at the postage vendor computer system and the custom postal rates transmitted to the postage vendor computer system, wherein the postage vendor computer system discards the one or more files in response to receiving the rejection message.

19. A method for securely disseminating and managing postal rates, the method being implemented by a postal service computer system having one or more processors, the method comprising:

sending, by the postal service computer system, a transmission that includes one or more files containing custom postal rates to a postage vendor computer system, wherein the transmission further includes information that identifies a particular mailer associated with the custom postal rates;

executing, by the postal service computer system, a comparison between one or more data fields that the postage vendor computer system identified in the one or more files and the custom postal rates sent in the transmission, wherein the one or more data fields represent the custom postal rates associated with the mailer;

determining, by the postal service computer system, whether the one or more data fields are identical to the customs postal rates transmitted to the postage vendor computer system;

if the one or more data fields are identical to the custom postal rates transmitted to the postage vendor, sending, by the postal service computer system to the postage vendor computer system, an approval message, wherein the postage vendor computer system enables the mailer to generate postage indicia at the custom postal rates in response to receiving the approval message; and if one or more discrepancies exist between the one or more data fields identified at the postage vendor computer system and the custom postal rates transmitted to the postage vendor computer system, sending, by the postal service computer system to the postage vendor computer system, a rejection message, wherein the postage vendor computer system discards the one or more files in response to receiving the rejection message.

* * * * *